US006398826B1

(12) United States Patent
Fujii et al.

(10) Patent No.: US 6,398,826 B1
(45) Date of Patent: Jun. 4, 2002

(54) ABRASIVE TAPE, PROCESS FOR PRODUCING IT, AND COATING AGENT FOR ABRASIVE TAPE

(75) Inventors: Kazuhito Fujii; Masahisa Yamaguchi; Takaki Miyachi; Kojiro Okawa; Yasuki Suzuura, all of Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/689,633

(22) Filed: Oct. 13, 2000

Related U.S. Application Data

(62) Division of application No. 09/276,088, filed on Jan. 7, 1999, now Pat. No. 6,165,061, which is a continuation of application No. 08/627,174, filed on Apr. 3, 1996, now abandoned.

(30) Foreign Application Priority Data

Apr. 10, 1995 (JP) ..... 7/109088
Jan. 16, 1996 (JP) ..... 8/5212

(51) Int. Cl.[7] ..... B24D 3/02; B24D 11/00

(52) U.S. Cl. ..... 51/295; 51/297; 51/308; 51/298; 451/533; 451/539; 451/526; 427/302; 427/299; 427/372.2; 427/397.7

(58) Field of Search ..... 51/298, 295, 293, 51/308, 297; 451/526, 533, 536, 539; 427/299, 302, 372.2, 397.7

(56) References Cited

U.S. PATENT DOCUMENTS

| | | | | |
|---|---|---|---|---|
| 3,170,273 | A | 2/1965 | Walsh et al. | |
| 4,169,337 | A | 10/1979 | Payne | |
| 4,368,235 | A | 1/1983 | Vaughn, Jr. | 428/412 |
| 4,818,806 | A | 4/1989 | Kunimune et al. | |
| 4,918,874 | A | 4/1990 | Tiefenbach, Jr. | 51/293 |
| 5,089,330 | A | 2/1992 | Sato et al. | 428/323 |
| 5,109,638 | A | 5/1992 | Kime, Jr. | |
| 5,162,426 | A | 11/1992 | Hazan et al. | |
| 5,203,882 | A | 4/1993 | Carman et al. | 51/293 |
| 5,213,589 | A | 5/1993 | Ronning et al. | 51/293 |
| 5,296,582 | A | 3/1994 | Fujita et al. | |
| 5,314,514 | A | 5/1994 | Sato | 51/295 |
| 5,456,734 | A | 10/1995 | Ryoke et al. | 51/295 |
| 5,611,826 | A | 3/1997 | Ryoke et al. | 451/28 |
| 5,633,068 | A | 5/1997 | Ryoke et al. | |
| 5,686,550 | A | 11/1997 | Noto et al. | |
| 5,709,922 | A | 1/1998 | Ono et al. | |

FOREIGN PATENT DOCUMENTS

| | | |
|---|---|---|
| JP | 5-57624 | 3/1993 |
| JP | 7-2662440 | 10/1995 |
| JP | 9-141547 | 6/1997 |
| WO | WO 96/01721 | 1/1996 |

OTHER PUBLICATIONS

Patent Abstracts of Japan, vol. 12, No. 459 (M–770), Dec. 2, 1988 & JP 63 185577 A (Fuji Photo Film Co. Ltd.), Aug. 1, 1988 *abstract*.

Patent Abstracts of Japan, vol. 17, No. 622 (C–1130), Nov. 17, 1993 & JP 05 192639 A (Koransha Co. Ltd.), Aug. 3, 1993 *abstract* & Database WPI Section Ch, Week 9335, Derwent Publications Ltd., London, GB; Class LP, AN 93–277624 (35) & JP 05 192 639 A (Koransha K.K.), Aug. 3, 1993 *abstract*.

Patent Abstracts of Japan, vol. 13, No. 327 (M–854), Jul. 24, 1989 & JP 01 109083 A (Tokyo Jiki Insatsu K.K.), Apr. 26, 1989, *abstract* & Database WPI Section Ch, Week 8923, Derwent Publications Ltd., London, GB; Class ALP, AN 89–168690 (23) & JP 01 109 083 A (Tokyo Jiki Insatsu K.K.), Apr. 26, 1989, *abstract*.

Patent Abstracts of Japan, vol. 12, No. 83 (M–677), Mar. 16, 1989 & JP 62 224581 A (Fuji Photo Film Co. Ltd.), Oct. 2, 1987, *abstract* & Database WPI, Section Ch, Week 8745, Derwent Publications Ltd., London, GB; Class ALP, AN 87–317124 (45) & JP 62 224 581 A (Fuji Photo Film Co. Ltd.), Oct. 2, 1987, *abstract*.

Patent Abstracts of Japan, vol. 14, No. 119 (M–0945), Mar. 6, 1990 & JP 01 316172 A (DAI Nippon Printing Co. Ltd.), Dec. 21, 1989, *abstract.

*Primary Examiner*—Michael Marcheschi

(57) ABSTRACT

Provided are an abrasive tape suitable for finishing of surfaces or the like of precision components such as optical connector ferrules and semiconductor wafers, and a process for producing it. A coating agent in which abrasive particles having an average particle size in the range of 1 to 200 m$\mu$ are dispersed in a binder resin solution. The coating agent is applied, with intervention of a primer layer if necessary, onto a base for abrasive tape to form an abrasive layer, thus obtaining an abrasive tape.

9 Claims, 2 Drawing Sheets

ABRASIVE TAPE, PROCESS FOR PRODUCING IT, AND COATING AGENT FOR ABRASIVE TAPE

This is a Division of application Ser. No. 09/276,088 filed Jan. 7, 1999 now U.S. Pat. No. 6,165,061 which in turn is a Rule 53(b) continuation of Ser. No. 08/627,174, filed Apr. 3, 1996, now abandoned.

BACKGROUND OF THE INVENTION

1. Field of the Invention

The present invention relates to an abrasive tape suitably applicable to finishing of surfaces, end faces, and so on of precision components such as optical connector ferrules, semiconductor wafers, metals, ceramics, color filters (for liquid crystal display or the like), plasma displays, optical lenses, substrates of magnetic disk or optical disk, magnetic heads, and optical reading heads, a process for producing it, and a coating agent for abrasive tape.

2. Related Background Art

The precision in grinding for finishing affects the quality of the precision components such as the optical connector ferrules and the semiconductor wafers, and grinding called mechanical polishing has been and is employed for finish grinding.

The mechanical polishing is carried out as follows. First, abrasive particles having particle diameters of 5 to 300 mμ are suspended in an alkaline solution such as caustic soda, ammonia, or ethanolamine to prepare an abrasive solution consisting of a colloidal solution of pH 9 to 12. While this abrasive solution is next supplied onto an abrasive cloth comprised of a resin sheet, for example a polyurethane sheet, a precision component such as the optical connector ferrule or the semiconductor wafer is ground on the abrasive cloth.

The above mechanical polishing using the abrasive solution and abrasive cloth has the following problems.

Changes will occur in the concentration of abrasive particles in the abrasive solution during grinding and in the particle size distribution of abrasive particles due to cohesion of abrasive particles, which could result in forming grinding scars or grinding spots on the ground body such as the optical connector ferrule or the semiconductor wafer. The mechanical polishing needs a process for washing the abrasive particles adhering to the surface of the ground body such as the optical connector ferrule or the semiconductor wafer away after completion of grinding, which makes the polishing step complex.

Against it, there is an idea to produce an abrasive tape obtained by applying a coating agent in which the abrasive particles are dispersed in a binder resin solution, onto a base for abrasive tape made of a plastic film and drying it to form an abrasive layer. The optical connector ferrules and semiconductor wafers, etc. are ground on this abrasive tape, but it cannot be used as an abrasive tape for finishing, because it is difficult in producing the abrasive tape to keep the abrasive particles of the particle diameters of 1μ less uniformly dispersed in the binder resin solution.

Namely, the high precision grinding for finishing is grinding with fine abrasive particles, but with a decrease in the particle diameters of abrasive particles it becomes difficult to uniformly disperse the fine abrasive particles in the binder because cohesion becomes likely to occur because of an increase in surface energy.

When the abrasive layer is formed from the coating agent containing the abrasive particles in a cohesive state, coarse particles of 5 to 10μ are produced in the abrasive layer, which unavoidably form grinding scars on the surface of the ground body.

SUMMARY OF THE INVENTION

The present invention has been accomplished under the above circumstances, and an object of the invention is to provide an abrasive tape in which the abrasive particles include no coarse particles in the abrasive layer but include only fine abrasive particles, which can realize precise mirror finishing of precision components such as the end faces of optical connector ferrules and the surfaces of semiconductor wafers, a process for producing it, and a coating agent for abrasive tape.

A first aspect of the present invention is an abrasive tape comprising: a base for abrasive tape; and an abrasive layer formed on the base; wherein the abrasive layer is formed from a coating agent in which abrasive particles of an average particle size in the range of 10 to 100 mμ are dispersed in a binder resin solution, with respect to a base for abrasive tape.

A second aspect of the present invention is a process for producing an abrasive tape, comprising the steps of dispersing abrasive particles of an average particle size in the range of 10 to 100 mμ in a binder resin solution, producing aggregates of the abrasive particles in the binder resin solution to obtain a coating agent containing the abrasive particles of particle diameters 50 to 800 mμ, and applying the coating agent onto a base for abrasive tape.

A third aspect of the present invention is an abrasive tape comprising: a base for abrasive tape; and an abrasive layer formed on the base; wherein the abrasive layer has abrasive particles of an average particle size in the range of 1 to 200 mμ and a binder for binding the abrasive particles.

A fourth aspect of the present invention is a coating agent for production of an abrasive tape, comprising an abrasive particle solution containing abrasive particles of an average particle size in the range of 1 to 200 mμ and a solvent for abrasive particles, and a binder resin solution containing a binder and a binder solvent.

A fifth aspect of the present invention is a process for producing an abrasive tape, comprising: the steps of preparing a base for abrasive tape; mixing an abrasive particle solution containing abrasive particles of an average particle size in the range of 1 to 200 mμ and a solvent for abrasive particles, with a binder resin solution containing a binder and a binder solvent to produce a coating agent; applying the coating agent onto the base for abrasive tape; and drying the coating agent thus applied.

According to the first aspect of the present invention, the abrasive layer is formed by applying the coating agent in which the abrasive particles of the average particle size in the range of 10 to 100 mμ are dispersed in the binder resin solution, onto the base for abrasive tape, whereby the abrasive particles in the abrasive layer can be fine particles having small and close particle diameters.

According to the second aspect of the present invention, the abrasive particles of the average particle size in the range of 10 to 100 mμ are dispersed in the binder resin solution, thereafter aggregates of the abrasive particles are produced in the binder resin to obtain the coating agent containing the abrasive particles of particle diameters 50 to 800 mμ, and then the coating agent is applied onto the base for abrasive tape, whereby the abrasive tape can be obtained with fine particles having small and close particle diameters of the abrasive particles in the abrasive layer.

According to the third aspect of the present invention, the average particle size of the abrasive particles in the abrasive layer formed on the base for abrasive tape can be kept between 1 and 200 mμ.

According to the fourth aspect of the present invention, the coating agent containing the abrasive of the average particle size in the range of 1 to 200 mμ can be readily obtained.

According to the fifth aspect of the present invention, the abrasive tape having the abrasive layer containing the abrasive of the average particle size in the range of 1 to 200 mμ can be produced.

DESCRIPTION OF THE PREFERRED EMBODIMENTS

First Embodied Form

Figure 1:
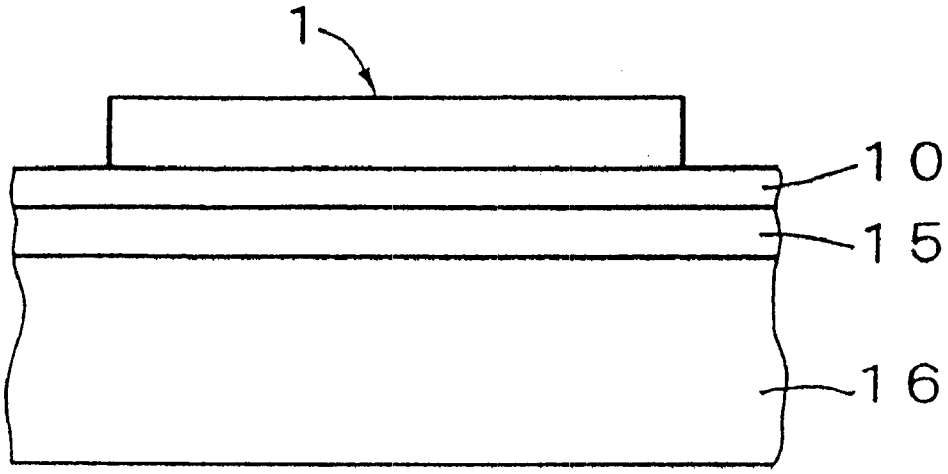
FIG. 1 is a drawing to show a grinding step using the abrasive tape according to the present invention.
Figure 2:
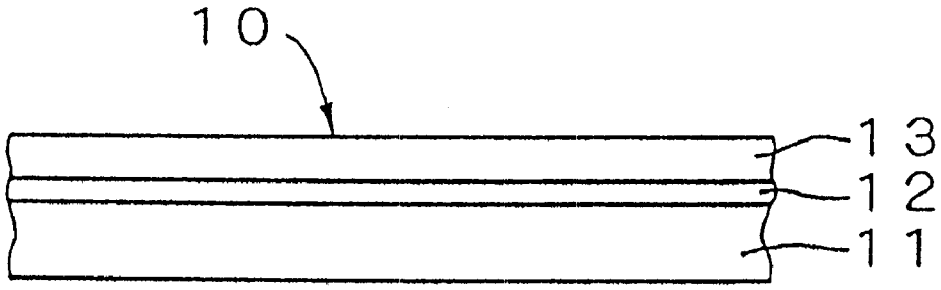
FIG. 2 is a drawing to show a layer structure of the abrasive tape.

Embodied forms of the present invention will be explained by reference to the drawings. FIG. 1 and FIG. 2 are drawings to show the first embodied form of the present invention.

FIG. 1 shows a precision component in a flat plate form, for example a semiconductor wafer 1. Such a semiconductor wafer 1 is subjected to finish grinding by the abrasive tape 10 (see FIG. 1). The flat-plate semiconductor wafer 1 is made of silicon.

As shown in FIG. 1, the abrasive tape 10 is placed through an elastic body 15 of an elastomer on a rotating metal plate 16.

The abrasive tape 10 is next explained referring to FIG. 2. As shown in FIG. 2, the abrasive tape 10 is composed of a base 11 for abrasive tape made of a polyester film or the like, a primer layer 12 mainly containing an epoxy resin, an acrylic resin, or a polyester resin, formed on the base 11 for abrasive tape, and an abrasive layer 13 formed on the primer layer 12. In this case, the abrasive tape 10 may be formed in a sheet form or in a band form. The primer layer 12 is not always essential, and is given taking adhesion between the base 11 and the abrasive layer 13 into consideration, depending upon materials forming them.

The abrasive layer 13 is formed by applying a coating agent in which the abrasive particles of an average particle size in the range of 10 to 100 mμ (nanometer nm) are dispersed in a binder resin solution, onto the primer layer 12 on the base 11 for abrasive tape. The primer layer 12 is not always essential.

When the abrasive layer is formed by applying the coating agent in which the abrasive particles of the average particle size in the range of 10 to 100 mμ (millimicron) are dispersed in the binder resin solution, onto the base 11 for abrasive tape, the particle diameters of the abrasive particles in the abrasive layer 13 become between 50 and 800 mμ.

In producing the abrasive tape 10, the abrasive particles of the average particle size in the range of 10 to 100 mμ are dispersed in the binder resin solution, and thereafter aggregates of the abrasive particles are formed in the dispersion to prepare the coating agent containing the abrasive particles of particle diameters between 50 and 800 mμ. Next, the coating agent is applied to the base for abrasive tape to produce the abrasive tape 10.

In the abrasive tape 10 of the present invention in the above structure and the process for producing it, the abrasive particles of the average particle size in the range of 10 to 100 mμ may be a silica sol or an alumina sol.

When silica or alumina of particle diameters of 1μ or less is dispersed in the binder resin solution, coarse particles of 5 to 10 μ are likely to be made. If the abrasive tape 10 should have the abrasive layer 13 formed utilizing such silica or alumina, grinding scars would be formed on the ground body because of the coarse particles in the abrasive layer 13.

In contrast with it, when silica or alumina of the average particle size in the range of 10 to 100 mμ is dispersed in the binder resin solution, the above coarse particles of 5 to 10μ are not formed, and thus, the abrasive tape having the abrasive layer 13 formed from such a coating agent is an abrasive tape suitable for finishing of the end face of optical connector ferrule and the surface of semiconductor wafer 1.

In order to obtain the abrasive layer 13 suitable for finishing and having high abrasiveness, the particle diameters of the abrasive particles in the abrasive layer 13 need to be between 50 and 800 mμ.

The abrasive layer 13, in which the particle diameters of the abrasive particles are in the range of 50 to 800 mμ, can be obtained by combination of the following conditions (1) and (2).

(1) To use nearly spherical silica or alumina particles having the average particle size in the range of 10 to 100 mμ as the abrasive particles in preparing the coating agent for forming the abrasive layer 13.

(2) To grow aggregates of the abrasive particles in the step of obtaining the coating agent by dispersing the abrasive particles in the binder resin solution or in the step of applying the coating agent in which the abrasive particles are dispersed in the binder resin solution, onto the base for abrasive tape, thereby obtaining the abrasive particles of particle diameters 50 to 800 mμ.

The particle diameters of silica particles dispersed in the binder resin solution can be adjusted between 50 and 800 mμ in such a manner that the dispersion in which the silica particles are dispersed in the binder resin solution is adjusted at pH of 7 to 9, the dispersion is slowly stirred for several hours to form aggregates of silica particles, and thereafter the resultant is filtered by a filter of 0.8μ to remove coarse particles.

If the binder resin solution has a silicone resin or a silicone based resin having the framework of Si atoms, the particle size distribution of the silica particles in the abrasive layer becomes narrower, thereby forming a more preferable abrasive layer 13.

Presumably, the reason is that, because the silicone resin or the silicone based resin as the binder resin solution has high affinity to the silica particles, the silica particles also come to cohere when the binder resin becomes solidified in the application and drying steps of the coating agent for forming the abrasive layer.

The base 11 for abrasive tape above which the abrasive layer 13 is formed in the above structure may be synthetic paper or a plastic film having excellent properties in mechanical strength, dimensional stability, heat resistance, etc., as described above, preferably about 20 to 100μ thick, for example selected from polyethylene terephthalate, oriented polypropylene, polycarbonate, acetyl cellulose diester, acetyl cellulose triester, oriented polyethylene, and polybutylene terephthalate.

In this embodied form, the abrasive layer 13 is formed by applying the coating agent in which the abrasive particles of the average particle size in the range of 10 to 100 mμ are dispersed in the binder resin solution, to the base 11 for abrasive tape, with intervention of the primer layer if necessary, whereby the coarse abrasive particles of 5 to 10μ are not formed in the abrasive layer 13. Using the abrasive tape 10 obtained in this manner, finishing of the end face of optical connector ferrule or the surface of semiconductor wafer 1 can be carried out without forming grinding scars or grinding spots on the surface of the ground body.

The abrasive tape 10 having the abrasive layer 13 in which the particle diameters of abrasive particles are between 50 and 800 mμ is suitable for the abrasive tape 10 for finishing the end face of optical connector ferrule and the surface of semiconductor wafer 1, etc., which is an abrasive tape 10 with high grinding performance.

Second Embodied Form

The second embodied form of the present invention is next explained. The second embodied form is substantially the same as the first embodied form except for the structure of the abrasive layer 13 in the abrasive tape 10.

Namely, the abrasive tape 10 is composed of the base 11 for abrasive tape made of a polyester film or the like, the primer layer 12 mainly containing an epoxy resin, an acrylic resin, or a polyester resin and formed on the base 11 for abrasive tape, and the abrasive layer 13 formed on the primer layer 12. The above primer layer 12 is not always essential, and is provided taking account of adhesion or the like of the base 11 and the abrasive layer 13, depending upon the materials forming the abrasive tape base 10, the abrasive layer 13, etc.

In the above structure the abrasive layer 13 has the abrasive particles of the average particle size in the range of 1 to 200 mμ (nanometer nm), for example colloidal silica particles, and the binder for binding the silica particles, for example an organic-inorganic composite polymer resin. In this case the organic-inorganic composite polymer resin is a polymer compound having the siloxane bonding in the structure.

In the abrasive layer 13 the colloidal silica particles are dispersed without cohesion as maintaining the average particle size in the range of 1 to 200 mμ, and the total ray transmittance of the abrasive layer 13 is between 60 and 95% and the haze thereof is between 1 and 70%.

The arithmetical mean deviation (Ra) of the surface of the abrasive layer 13 is between 0.005 and 0.5μ, and in most cases Ra is within the range of 0.007 to 0.2μ.

Materials for the respective components will be described in more detail.

(1) Concerning the binder in the abrasive layer.

In the present invention, the binder may be a monomer, a prepolymer or oligomer, or a polymer having the siloxane bonding (Si—O bonding) in its structure, for example selected from a polysiloxane, derivatives thereof, modifications thereof, or blends thereof, and further a monomer, a prepolymer or oligomer thereof, etc.

Specifically, the binder may be, for example, not only the monomer, the prepolymer or oligomer, or the polymer, forming the polysiloxane, but also a blend, a reaction modification, or the like of the monomer, the prepolymer or oligomer, or the polymer forming the polysiloxane, for example mixed with a monomer, a prepolymer or oligomer, or a polymer forming one of polyethylene based resins, polyvinyl chloride based resins, polyvinyl acetate based resins, polyacrylic based or polymethacrylic based resins, polyvinyl alcohol based resins, ethylene copolymers, polyvinyl acetal based resins, rubber based resins, polyester based resins, polyamide based resins, phenol based resins, aminoplast based resins, epoxy resins, polyurethane based resins, cellulose based resins, and other resins.

Particularly, in the present invention, it is preferred to use a blend or a reaction modification in which the prepolymer or oligomer or the polymer of polysiloxane is mixed with a prepolymer or oligomer or a polymer of one selected from the polyethylene based resins, polyvinyl chloride based resins, polyvinyl acetate based resins, polyacrylic based resins, polyurethane based resins, and polyester based resins.

Explaining in further detail, in the present invention a desired material for the binder may be selected from organic-inorganic composite polymers having organic main chains and inorganic side chains of siloxane bonding, obtained by binding the main chains of a prepolymer or oligomer or a polymer of one of the polyethylene based resins, polyvinyl chloride based resins, polyvinyl acetate resins, polyacrylic based resins, polyurethane based resins, and polyester based resins with the side chains of the prepolymer or oligomer or the polymer of polysiloxane for example by graft polymerization or the like; prepolymers or oligomers thereof, etc.

Use of the organic-inorganic composite polymer as described above presents the advantage that the abrasive particles can maintain the state of primary particles without cohesion in the coating agent or in the abrasive layer, whereby the abrasive tape suitable for fine grinding can be produced.

It is not clearly known why the abrasive particles can maintain the state of primary particles as described above in the present invention, but it is presumed that, as detailed later, if the resin used as the binder has the siloxane bonding (Si—O bonding) and, for example, when the colloidal silica particles are used as the abrasive particles, the binder and silica particles will have functional groups of Si atoms common to each other, and have affinity to each other, whereby the abrasive particles can maintain the state of primary particles even in the state of a composition as the coating agent or in the state of the abrasive layer in a coating film form, enabling to produce the abrasive tape realizing very good grinding finishing.

(2) Concerning the primer layer.

In the present invention, the primer layer may be formed by coating or printing of a composition with a vehicle mainly containing one or more of a monomer, a prepolymer or oligomer, or a polymer forming a resin, for example selected from polyvinyl chloride based resins, polyvinyl acetate based resins, polyacrylic based or polymethacrylic based resins, polyvinyl alcohol based resins, ethylene copolymers, polyvinyl acetal based resins, rubber based resins, polyester based resins, polyamide based resins, phenol based resins, aminoplast based resins, epoxy based resins, polyurethane based resins, silicone based resins, cellulose based resins, and other resins.

Further, a curing agent such as isocyanate may be added in order to enhance adhesion.

(3) Concerning the abrasive particles in the abrasive layer.

In the present invention, the abrasive particles may be of an inorganic compound, for example selected from alumina (aluminum oxide), titanium oxide, zirconia (zirconium oxide), lithium silicate, diamond, silicon nitride, silicon carbide, iron oxide, chromium oxide, silica (silicon dioxide), and antimony oxide.

Since the abrasive sheet suitable for fine grinding is produced in the present invention, the above abrasive particles are preferably those having the particle diameters in the range of about 1 to 300 mμ, more preferably in the range of about 1 to 200 mμ, and in the state of primary particles.

Particularly, in the present invention, use of silica (silicon dioxide) is most preferred as abrasive particles, considering the affinity and compatibility with the binder.

In the present invention, when the abrasive particles are, for example, of the particle diameters of 5 to 50 mμ and when the formulation rate (% by weight) of the abrasive particles and the binder is in the range of 90:10 to 60:40, the abrasive sheet obtained is a relatively transparent abrasive sheet having the total ray transmittance in the range of 90 to 95% and the haze in the range of 2 to 15%, and the abrasive sheet has an aptitude for finish grinding of the surface of precision component such as the optical connector ferrule.

When the abrasive particles are, for example, of the particle diameters in the range of 50 to 200 mμ and when the formulation rate (% by weight) of the abrasive particles and the binder is in the range of 90:10 to 30:70, the abrasive sheet obtained becomes a relatively cloudy white or semi-transparent abrasive tape and has an aptitude for finish grinding of the surface of precision component such as the optical connector ferrule, similarly as described above.

The above phenomenon is particularly outstanding when silica particles are used as the abrasive particles.

In the present invention, if the abrasive particles become less than the binder in the formulation rate of the abrasive particles and the binder, the surface finish grinding aptitude of the abrasive tape obtained tends to be somewhat degraded.

For example, when the particle diameters are of 5 to 50 mμ and when an amount of the binder is increased to be more than that of the abrasive particles in the formulation rate (% by weight) of the abrasive particles and binder, the surface finish grinding aptitude of the abrasive tape obtained shows a tendency to be considerably lowered.

The reason of it is not clear, but it is presumed that the abrasive particles are not exposed from the surface in the binder and thus, cannot demonstrate the abrasive ability.

The process for producing the abrasive tape 10 is next explained.

First prepared is the base 11 for abrasive tape made of a polyester film, for example a biaxially oriented polyethylene terephthalate, and having the thickness of 10 to 200μ, preferably the thickness of 50 to 100μ. Next, the primer layer 12 mainly containing, for example, the epoxy resin, the acrylic resin, or the polyester resin is applied, if necessary, onto the abrasive tape 10. This coating of the primer layer 12 prevents the abrasive layer 13 from being peeled off from the base 11 for abrasive tape while the optical fiber 2 is ground by the abrasive tape 10.

The coating agent is next prepared by mixing the colloidal silica sol (abrasive particle solution) containing, for example, colloidal silica particles of the average particle size in the range of 1 to 200 mμ and the abrasive particle solvent such as isopropyl alcohol with the binder resin solution containing, for example, the organic-inorganic composite polymer resin (binder) and the binder solution such as isopropyl alcohol.

In this case, the colloidal silica particles maintain the average particle size in the range of 1 to 200 mμ in the coating agent, as being dispersed without cohesion.

A curing agent for curing the organic-inorganic composite polymer resin, for example an organic metal solution such as a tin compound, may be mixed in the coating agent, and a dispersing agent for dispersing the colloidal silica particles, for example a nonionic surfactant, may also be mixed in the coating agent.

In the case where the curing agent is mixed in the coating agent, a ratio of a solution of the curing agent to the organic-inorganic composite polymer resin (solid content) is preferably 90:10.

A P/V weight ratio, which is colloidal silica particles (solid content)/organic-inorganic composite polymer silicone resin (solid content), in the coating agent is in the range of 20:80 to 95:5 (weight ratio), and preferably, the P/V weight ratio=50:50 to 80:20.

The coating agent is next applied by the gravure reverse process onto the primer layer 12 on the base 11 for abrasive tape. After the coating agent is applied onto the primer layer 12 on the base 11 for abrasive tape, the base 11 for abrasive tape is immediately heated at the temperature of 110° C. to 120° C. for 30 seconds, and during this period the solvent including isopropyl alcohol in the coating agent is scattered into the air.

Next, if the curing agent is mixed in the coating agent, the base 11 for abrasive tape is further heated at 80° C. for 10 minutes. On the contrary, if the curing agent is not mixed in the coating agent, the base 11 for abrasive tape is heated at 100° C. for one hour. The coating agent is thus dried to form the abrasive layer 13 in the thickness of 0.5 to 10μ, preferably 3 to 5μ, on the primer layer 12, thus obtaining the abrasive tape 10.

After the coating agent is dried under the above conditions, the colloidal silica particles can be dispersed as maintaining the average particle size in the range of 1 to 200 mμ in the abrasive layer 13 without cohesion.

Namely, unless the solvent including isopropyl alcohol is scattered immediately after application of the coating agent, the average particle size of the colloidal silica particles becomes large because the time is given for cohesion of the colloidal silica particles in the coating agent.

As described above, the colloidal silica particles in the coating agent can maintain the average particle size in the range of 1 to 200 mμ in all of the preparation step of the coating agent, the application step of the coating agent onto the primer layer 12, and the drying step after that. Also, the colloidal silica particles maintain the average particle size in the range of 1 to 200 mμ in the abrasive layer 13.

The reason why the colloidal silica particles maintain the average particle size in the range of 1to 200 mμ is approximately as follows.

Generally, if the coating agent is prepared by dispersing particles of particle diameters of 1 or less μ in a binder resin solution such as a polyester, a polyester urethane, or a polyvinyl chloride-polyvinyl acetate copolymer, which is widely used as a binder resin solution, coarse particles of 5 to 10μ are likely to be made because of cohesion. Because of that, the abrasive tape having the abrasive layer formed using this coating agent forms scars on the ground body due to the coarse particles in the abrasive layer.

On the contrary, there are no such coarse particles of 5 to 10μ formed in the coating agent prepared by mixing the colloidal silica sol containing the colloidal silica particles of the average particle size in the range of 1 to 200 mμ with the binding resin solution containing the organic-inorganic composite polymer resin, according to the present invention. Because of that, the abrasive sheet having the abrasive layer formed using this coating agent becomes the abrasive sheet suitable for finishing of the end face of optical connector ferrule and the end face of semiconductor wafer 1.

According to the present invention, the colloidal silica as the abrasive particles has the silanol group while the organic-inorganic composite polymer resin in the resin solution has a functional group such as polysiloxane oligomer having the framework of Si atoms. This polysiloxane oligomer is a functional group with high affinity to the silanol group, and, therefore, colloidal silica can be dispersed without cohesion in the binder resin solution. In the coating agent prepared by mixing the colloidal silica sol in which colloidal silica is stably dispersed in the organic solvent such as isopropyl alcohol, with the resin solution with low viscosity similarly containing the organic solvent such as isopropyl alcohol, the colloidal silica sol and the binder resin solution contain the same or similar organic solvents, which facilitates dispersion of colloidal silica in the binder resin solution and which can suppress formation of aggregates of colloidal silica in the coating agent. These organic solvents may be selected from methanol, ethanol, xylene-butanol, ethylene glycol, ethylene glycol-mono n-propyl ether, dimethylacetamide, and methyl isobutyl ketone, as well as isopropyl alcohol.

If the base 11 for abrasive tape, the primer layer 12, and the abrasive layer 13 in the abrasive tape 10 all have transparency, it is hard to distinguish the surface of the base from the surface of the abrasive layer, which could cause erroneous use. To prevent it, the base for abrasive tape may be subjected to coloring or printing of character or pattern.

Using the abrasive tape thus produced, the end face of optical connector ferrule or the surface of semiconductor wafer 1 is ground. Next explained is a method for grinding a surface of optical connector ferrule 2.

Figure 3:
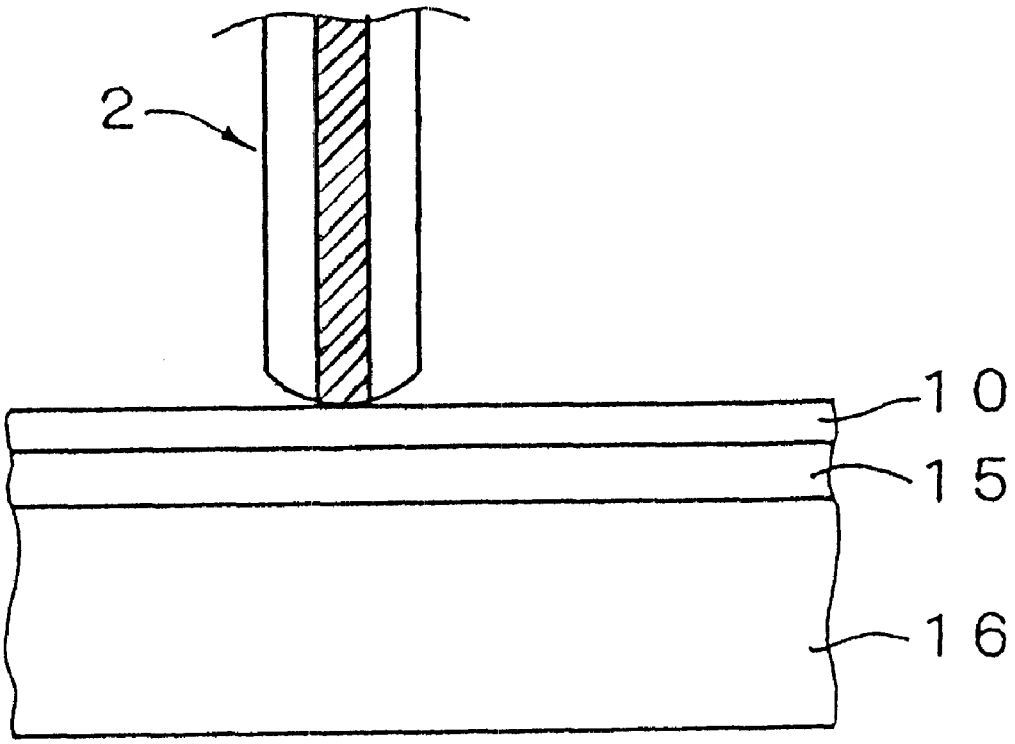
FIG. 3 is a drawing to show a grinding operation of an optical connector ferrule.

As shown in FIG. 3, the abrasive tape 10 according to the present invention is placed through the elastic body 15 of elastomer on the rotating metal plate 16, and the surface of optical connector ferrule 2 is ground with a lubricant of water for about two minutes on the abrasive tape 10. Since the abrasive layer 13 of the abrasive tape 10 has no coarse particles of 5 to 10$\mu$ due to cohesion as described above, the surface of optical connector ferrule 2 can be ground with efficiency.

Namely, the optical connector ferrule 2 can be ground uniformly and precisely by avoiding formation of the coarse particles of 5 to 10$\mu$ due to cohesion in the abrasive layer 13 of the abrasive tape 10 as in the present invention. Since no scar is formed on the optical connector ferrule 2, there is no need to supply an abrasive solution containing another abrasive during grinding. Some ground bodies can be further efficiently ground when a lubricant is supplied during grinding. The lubricant may be one generally known, such as water, alcohol, a surfactant, oil or the like. In this case, no abrasive is contained in the lubricant. When the lubricant is used, handling is easier and workability is better than in the mechanical polishing using an abrasive solution containing an abrasive.

During grinding, no clogging occurs in the abrasive layer 13 of the abrasive tape 10 and the abrasive layer 13 gradually decreases as a whole. Thus, since the life of the abrasive tape 10 continues as long as the abrasive layer 13 exists, the life of the abrasive tape 10 can be maintained long.

The same effect can be achieved when the precision component such as the semiconductor wafer 1 is ground instead of the optical connector ferrule 2.

First Embodiment

The first embodiment of the present invention is next explained. The first embodiment corresponds to the first embodied form.

Specific examples of the abrasive tape and the production process thereof according to the present invention will be explained based on the following examples.

EXAMPLE 1

Coating Agent for Abrasive Layer 10 parts by weight of a water-based silica sol [Snowtex 30 available from Nissan Chemical Industries] having the average particle size in the range of 10 to 20 m$\mu$ was added to 10 parts by weight of a water-dispersed polymer polyester resin solution [Vylonal MD 1200 available from TOYOBO CO., LTD.] and thereafter the mixture was stirred, thereby obtaining the coating agent [a] for abrasive layer having the viscosity of 100 cps.

Production of Abrasive Tape

The above coating agent [a] for abrasive layer was applied in 20 g (dry)/m$^2$ by the three-roll reverse process on one side of the base for abrasive tape comprised of a polyethylene terephthalate film [low heat shrinkage SG type available from TEIJIN LTD.] having the thickness of 50$\mu$, and it was dried, thereby obtaining the abrasive tape (A) as an example product of the present invention.

This abrasive tape (A) was used to remove the haze as finishing of the surface of a 5-inch silicon wafer, which confirmed that finishing was able to be completed without any grinding scar or grinding spot.

EXAMPLE 2

Coating Agent for Abrasive Layer

A mixture solution of 10 parts by weight of the water-based silica sol [Snowtex 30 available from Nissan Chemical Industries having the average particle size in the range of 10 to 20 m$\mu$ with 10 parts by weight of the water-dispersed polymer polyester resin solution [Vylonal MD 1200 available from TOYOBO CO., LTD.] was adjusted by an organic acid to pH 7.5, thereafter the mixture was stirred slowly for four hours, and then the mixture was filtered by a filter of 0.8 $\mu$, thereby obtaining the coating agent [b] for abrasive layer having the viscosity of 100 cps.

Production of Abrasive Tape

The above coating agent [b] for abrasive layer was applied in 20 g (dry)/m$^2$ by the three-roll reverse process on one side of the base for abrasive tape comprised of the polyethylene terephthalate film [low heat shrinkage SG type available from TEIJIN LTD.] having the thickness of 50$\mu$, and it was dried, thereby obtaining the abrasive tape (B) as an example product of the present invention.

The abrasive layer in the abrasive tape (B) was whitened, from which it is apparent that aggregates of silica particles occurred in the abrasive layer.

The abrasive layer of the abrasive tape (B) was observed with an electron microscope, and it was confirmed that the particle diameters of the silica particles in the abrasive layer ranged from 0.1 to 0.8 $\mu$ (100 to 800 m$\mu$).

This abrasive tape (B) was used to remove the haze as finishing of the surface of 5-inch silicon wafer, from which grinding performance of 0.1$\mu$ or better was confirmed.

EXAMPLE 3

Coating Agent for Abrasive Layer 10 parts by weight of the isopropanol silica sol [IPA-ST available from Nissan Chemical Industries] having the average particle size in the range of 10 to 20 m$\mu$ was added to 10 parts by weight of a silicone based coating agent [Glassca HPC 7502 available from Japan Synthetic Rubber], and thereafter the mixture was stirred, thereby obtaining the coating agent [c] for abrasive layer having the viscosity of 100 cps.

Production of Abrasive Tape

The above coating agent [c] for abrasive layer was applied in 20 g (dry)/m$^2$ by the three-roll reverse process on one side of the base for abrasive tape comprised of the polyethylene terephthalate film [low heat shrinkage SG type available from TEIJIN LTD.] having the thickness of 50$\mu$, and it was dried, thereby obtaining the abrasive tape (C) as an example product of the present invention.

This abrasive tape (C) was used to grind the end face of optical connector ferrule, which confirmed that finishing was able to be performed with little grinding scar or grinding spot.

EXAMPLE 4

The coating agent [c] for abrasive layer used in Example 3 was applied in 30 g (dry)/m$^2$ by the three-roll reverse process onto one surface of the base for abrasive tape comprised of the polyethylene terephthalate film [low heat shrinkage SG type available from TEIJIN LTD.] having the thickness of 50$\mu$ and thereafter the resultant was dried, thereby obtaining the abrasive tape (D) having the abrasive layer of the thickness 20$\mu$ as an example product of the present invention.

When this abrasive tape (D) was used to grind the end face of optical connector ferrule, mirror finishing was achieved without any grinding scar or grinding spot, thereby obtaining the optical connector ferrule excellent in the damping property of signal.

EXAMPLE 5

Coating Agent for Abrasive Layer

The colloidal silica [Snowtex 30 available from Nissan Chemical Industries] having the average particle size in the range of 10 to 20 m$\mu$ was mixed at polyester resin/silica=1/1 (weight ratio) into a water-dispersed polyester resin solution [Vylonal MD-1245 available from TOYOBO CO., LTD.] and thereafter an ammonia solution was added thereto to adjust it to pH 7.

After the mixture was stirred for two hours, it was filtered by the filter of 0.8$\mu$ to obtain the coating agent [e] for abrasive layer.

Production of Abrasive Tape

The above coating agent [e] for abrasive layer was applied in 30 g (dry)/m$^2$ by the three-roll reverse process on one side of the base for abrasive tape comprised of the polyethylene terephthalate film (low heat shrinkage SG type available from TEIJIN LTD.] having the thickness of 50$\mu$, and it was dried, thereby obtaining the abrasive tape (E) as an example product of the present invention.

When this abrasive tape (E) was used to grind the end face of optical connector ferrule, mirror finishing was achieved without any grinding scar or grinding spot, thereby obtaining the optical connector ferrule excellent in the damping property of signal.

Second Embodiment

The second embodiment is next explained. The second embodiment corresponds to the second embodied form.

EXAMPLE 6

Coating Agent for Abrasive Layer 80 parts by weight of a colloidal silica sol [Organosilica sol IPA-ST, isopropyl alcohol solvent, solid content 30% available from Nissan Chemical Industries] having the average particle size in the range of 10 to 15 m$\mu$ was added to 20 parts by weight of an organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (f) for abrasive layer.

80 parts by weight of the colloidal silica sol [Organosilica sol IPA-ST, isopropyl alcohol solvent, solid content 30% available from Nissan Chemical Industries] having the average particle size in the range of 10 to 15 m$\mu$ and 2 parts by weight of a curing agent [HPC 404H available from Japan Synthetic Rubber] were added to 20 parts by weight of the organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (g) for abrasive layer.

3 parts by weight of a dispersing agent [a carboxylic acid dispersing agent available from Japan Synthetic Rubber], 80 parts by weight of the colloidal silica sol [Organosilica sol IPA-ST, isopropyl alcohol solvent, solid content 30% available from Nissan Chemical Industries] having the average particle size in the range of 10 to 15 m$\mu$, and 2 parts by weight of the curing agent [HPC 404H available from Japan Synthetic Rubber] were added to 20 parts by weight of the organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (h) for abrasive layer.

Here are the characteristics of the above materials, Glassca HPC 7502, HPC 404H, and IPA-ST shown in the following table.

TABLE 1

| Glassca HPC7502 | HPC404H | IPA-ST |
|---|---|---|
| Solvent Methanol | Solvent Isobutanol | Solvent Isopropanol |
| Solid content 31% | Solid content Less than 1% | Solid content 30% |
| Viscosity 4–16 cps | Viscosity 2–15 cps | Viscosity 3–20 cps |

Process for Producing the Abrasive Tape

The above coating agent for abrasive layer (f), (g) or (h) was subjected to filtering at filtration accuracy of 1 $\mu$. Then the above coating agent (f), (g) or (h) was applied in 5 g (dry)/m$^2$ by the gravure reverse process (screen ruling plate of 95 rulings and plate depth 80$\mu$) onto one surface (adhesion-enhanced surface) of the base for abrasive tape comprised of a polyethylene terephthalate film [adhesion-enhanced Melinex 542 type available from ICI Japan] having the thickness of 75$\mu$ and the resultant was heated and dried, thereby obtaining the abrasive tape (F) (when the coating agent (f) for abrasive layer was used), (G) (when the coating agent (g) for abrasive layer was used), or (H) (when the coating agent (h) for abrasive layer was used) having the abrasive layer in the thickness of 3$\mu$ (dry).

On the other hand, an anchor coating [an epoxy based anchor coating available from Japan Synthetic Rubber] was applied in 1 g (dry)/m$^2$ by the gravure reverse process (screen ruling plate of 200 rulings and plate depth 30$\mu$) onto one surface (corona-treated surface) of the base for abrasive tape comprised of a polyethylene terephthalate film [corona-treated E 5100 type available from TOYOBO Co., LTD.] having the thickness of 75$\mu$ to form the primer layer. Then the above coating agent (f), (g) or (h) for abrasive layer was applied each in 5 g (dry)/m$^2$ by the gravure reverse process (screen ruling plate of 95 rulings and plate depth of 80$\mu$) onto the primer layer and the resultant was heated and dried, thereby obtaining the abrasive tape F' (when the coating agent (f) for abrasive layer was used), G' (when the coating agent (g) for abrasive layer was used), or H' (when the coating agent (h) for abrasive layer was used) having the abrasive layer in the thickness of 3$\mu$ (dry).

The abrasive layer in each abrasive tape (F), (G), (H), (F'), (G'), (H') obtained by the above process did not contain the coarse particles of 5 to 10$\mu$ due to cohesion of abrasive particles, and the arithmetical mean deviation (Ra) of the surface of the abrasive layer was as fine as about 0.1$\mu$. Here, the arithmetical mean deviation (Ra) of the surface of each abrasive layer was measured by the surface roughness configuration meter, Surfcom 590A available from TOKYO SEIMITSU, with the cut-off value 0.8 mm (the same measurement was carried out also in below Examples 7 to 13). The total ray transmittance of the abrasive tape (F) was 91% and the haze thereof was 9%, showing transparency.

EXAMPLE 7

Coating Agent for Abrasive Layer 70 parts by weight of the colloidal silica sol [Organosilica sol IPA-ST, isopropyl alcohol solvent, solid content 30% available from Nissan Chemical Industries] having the average particle size in the range of 10 to 15 mμ was added to 30 parts by weight of the organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (i) for abrasive layer.

Process for Producing the Abrasive Tape

The above coating agent for abrasive layer (i) was subjected to filtering at filtration accuracy of 1μ. Then the above coating agent (i) was applied in 5 g (dry)/$m^2$ by the gravure reverse process (screen ruling plate of 95 rulings and plate depth 80μ) onto one surface (adhesion-enhanced surface) of the base for abrasive tape comprised of the polyethylene terephthalate film [adhesion-enhanced Melinex 542 type available from ICI Japan] having the thickness of 75μ and the resultant was heated and dried, thereby obtaining the abrasive tape (I) having the abrasive layer in the thickness of 3μ (dry).

The abrasive layer in the abrasive tape (I) obtained by the above process did not contain the coarse particles of 5 to 10μ due to cohesion of abrasive particles, and the arithmetical mean deviation (Ra) of the surface of the abrasive layer was as fine as about 0.2μ. The total ray transmittance of the abrasive tape was 92% and the haze was 10%, thus showing transparency.

EXAMPLE 8

Coating Agent for Abrasive Layer 65 parts by weight of the colloidal silica sol [Organosilica sol IPA-ST, isopropyl alcohol solvent, solid content 30% available from Nissan Chemical Industries] having the average particle size in the range of 10 to 15 mμ was added to 35 parts by weight of the organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (j) for abrasive layer.

Process for Producing the Abrasive Tape

The above coating agent for abrasive layer (j) was subjected to filtering at filtration accuracy of 1μ. Then the above coating agent (j) was applied in 5 g (dry)/$m^2$ by the gravure reverse process (screen ruling plate of 95 rulings and plate depth 80μ) onto one surface (adhesion-enhanced surface) of the base for abrasive tape comprised of the polyethylene terephthalate film [adhesion-enhanced Melinex 542 type available from ICI Japan] having the thickness of 75μ and the resultant was heated and dried, thereby obtaining the abrasive tape (J) having the abrasive layer in the thickness of 3μ (dry).

The abrasive layer in the abrasive tape (J) obtained by the above process did not contain the coarse particles of 5 to 10μ due to cohesion of abrasive particles, and the arithmetical mean deviation (Ra) of the surface of the abrasive layer was as fine as about 0.1μ. The total ray transmittance of the abrasive tape was 92% and the haze was 13%, thus showing transparency.

EXAMPLE 9

Coating Agent for Abrasive Layer 200 parts by weight of the colloidal silica sol [Organosilica sol IPA-ST, isopropyl alcohol solvent, solid content 30% available from Nissan Chemical Industries] having the average particle size in the range of 10 to 15 mμ was added to 30 parts by weight of a silicone varnish [KR-220IPA, isopropyl alcohol solvent, solid content 51% available from Shin-Etsu Kagaku Kogyo] and thereafter ultrasonic dispersion was carried out, thereby obtaining the coating agent (k) for abrasive layer.

Process for Producing the Abrasive Tape

The above coating agent for abrasive layer (k) was subjected to filtering at filtration accuracy of 1μ. Then the above coating agent (k) was applied in 5 g (dry)/$m^2$ by the gravure reverse process (screen ruling plate of 95 rulings and plate depth 80μ) onto one surface (adhesion-enhanced surface) of the base for abrasive tape comprised of the polyethylene terephthalate film [adhesion-enhanced Melinex 542 type available from ICI Japan] having the thickness of 75μ and the resultant was heated and dried, thereby obtaining the abrasive tape (K) having the abrasive layer in the thickness of 3μ (dry).

The abrasive layer in the abrasive tape (K) obtained by the above process did not contain the coarse particles of 5 to 10μ due to cohesion of abrasive particles, and the arithmetical mean deviation (Ra) of the surface of the abrasive layer was as fine as 0.3 or less μ. The abrasive tape had transparency.

EXAMPLE 10

Coating Agent for Abrasive Layer 80 parts by weight of the colloidal silica sol [Organosilica sol IPA-ST, isopropyl alcohol solvent, solid content 30% available from Nissan Chemical Industries] having the average particle size in the range of 70 to 100 mμ was added to 20 parts by weight of the organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (1) for abrasive layer.

Process for Producing the Abrasive Tape

The above coating agent for abrasive layer (1) was subjected to filtering at filtration accuracy of 1μ. Then the above coating agent (1) was applied in 5 g (dry)/$m^2$ by the gravure reverse process (screen ruling plate of 95 rulings and plate depth 80μ) onto one surface (adhesion-enhanced surface) of the base for abrasive tape comprised of the polyethylene terephthalate film [adhesion-enhanced Melinex 542 type available from ICI Japan] having the thickness of 75μ and the resultant was heated and dried, thereby obtaining the abrasive tape (L) having the abrasive layer in the thickness of 3μ (dry).

The abrasive layer in the abrasive tape (L) obtained by the above process did not contain the coarse particles of 5 to 10μ due to cohesion of abrasive particles, and the arithmetical mean deviation (Ra) of the surface of the abrasive layer was as fine as about 0.2μ. The total ray transmittance of the abrasive tape was 85% and the haze was 61%, thus showing semitransparency.

EXAMPLE 11

Coating Agent for Abrasive Layer 70 parts by weight of the colloidal silica sol [Organosilica sol IPA-ST, isopropyl alcohol solvent, solid content 30% available from Nissan Chemical Industries] having the average particle size in the range of 70 to 100 mμ was added to 30 parts by weight of the organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (m) for abrasive layer.

Process for Producing the Abrasive tape

The above coating agent for abrasive layer (m) was subjected to filtering at filtration accuracy of 1μ. Then the above coating agent (m) was applied in 5 g (dry)/$m^2$ by the gravure reverse process (screen ruling plate of 95 rulings and plate depth 80μ) onto one surface (adhesion-enhanced surface) of the base for abrasive tape comprised of the polyethylene terephthalate film [adhesion-enhanced Melinex 542 type available from ICI Japan] having the thickness of 75μ and the resultant was heated and dried, thereby obtaining the abrasive tape (M) having the abrasive layer in the thickness of 3μ (dry).

The abrasive layer in the abrasive tape (M) obtained by the above process did not contain the coarse particles of 5 to 10μ due to cohesion of abrasive particles, and the arithmetical mean deviation (Ra) of the surface of the abrasive layer was as fine as about 0.2μ. The total ray transmittance of the abrasive tape was 87% and the haze was 68%, thus showing semitransparency.

EXAMPLE 12

Coating Agent for Abrasive Layer 60 parts by weight of the colloidal silica sol [Organosilica sol IPA-ST, isopropyl alcohol solvent, solid content 30% available from Nissan Chemical Industries] having the average particle size in the range of 70 to 100 mμ was added to 40 parts by weight of the organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (n) for abrasive layer.

Process for Producing the Abrasive Tape

The above coating agent for abrasive layer (n) was subjected to filtering at filtration accuracy of 1μ. Then the above coating agent (n) was applied in 5 g (dry)/$m^2$ by the gravure reverse process (screen ruling plate of 95 rulings and plate depth 80μ) onto one surface (adhesion-enhanced surface) of the base for abrasive tape comprised of the polyethylene terephthalate film [adhesion-enhanced Melinex 542 type available from ICI Japan] having the thickness of 75μ and the resultant was heated and dried, thereby obtaining the abrasive tape (N) having the abrasive layer in the thickness of 3μ (dry).

The abrasive layer in the abrasive tape (N) obtained by the above process did not contain the coarse particles of 5 to 10μ due to cohesion of abrasive particles, and the arithmetical mean deviation (Ra) of the surface of the abrasive layer was as fine as about 0.2μ. The total ray transmittance of the abrasive tape was 89% and the haze was 46%, thus showing semitransparency.

EXAMPLE 13

Coating Agent for Abrasive Layer 50 parts by weight of the colloidal silica sol [Organosilica sol IPA-ST, isopropyl alcohol solvent, solid content 30% available from Nissan Chemical Industries] having the average particle size in the range of 70 to 100 mμ was added to 50 parts by weight of the organic-inorganic composite polymer silicone resin solution [ceramic coat material Glassca HPC 7502, methanol solvent, solid content 30% available from Japan Synthetic Rubber] and thereafter ultrasonic dispersion was carried out, thereby obtaining the coating agent (o) for abrasive layer.

Process for Producing the Abrasive Tape

The above coating agent for abrasive layer (o) was subjected to filtering at filtration accuracy of 1μ. Then the above coating agent (o) was applied in 5 g (dry)/$m^2$ by the gravure reverse process (screen ruling plate of 95 rulings and plate depth 80μ) onto one surface (adhesion-enhanced surface) of the base for abrasive tape comprised of the polyethylene terephthalate film [adhesion-enhanced Melinex 542 type available from ICI Japan] having the thickness of 75μ and the resultant was heated and dried, thereby obtaining the abrasive tape (O) having the abrasive layer in the thickness of 3μ (dry).

The abrasive layer in the abrasive tape (O) obtained by the above process did not contain the coarse particles of 5 to 10μ due to cohesion of abrasive particles, and the arithmetical mean deviation (Ra) of the surface of the abrasive layer was as fine as about 0.2μ. The total ray transmittance of the abrasive tape was 90% and the haze was 20%, thus showing transparency.

Table 2 below shows results of evaluation about the total ray transmittance, haze, appearance, and grinding characteristics of optical connector for the abrasive tapes (F), (I), (J), (L), (M), (N), (O) obtained by the above processes.

TABLE 2

| | Abrasive tape | Silica average particle size (mμ) | PV ratio silica/binder (weight ratio) | Total ray transmittance (%) | Haze (%) | Appearance | Grinding characteristics of optical connector |
|---|---|---|---|---|---|---|---|
| Example 6 | F | 10–15 | 80/20 | 91 | 9 | Transparent | ○ |
| Example 7 | I | 10–15 | 70/30 | 92 | 10 | Transparent | ○ |
| Example 8 | J | 10–15 | 65/35 | 92 | 13 | Transparent | ○ |
| Example 10 | L | 70–100 | 80/20 | 85 | 61 | Semitransparent | ○ |
| Example 11 | M | 70–100 | 70/30 | 87 | 68 | Semitransparent | ○ |
| Example 12 | N | 70–100 | 60/40 | 89 | 46 | Semitransparent | ○ |
| Example 13 | O | 70–100 | 50/50 | 90 | 20 | Transparent | ○ |

In Table 2 the total ray transmittance (%) and haze (%) were measured by the color computer (SM-5 available from Suga Shikenki Kabushiki Kaisha). The grinding characteristics of optical connector are results obtained in such a manner that the optical connector (zirconia ferrule) was subjected to finish grinding using the abrasive tape of each example in the optical fiber grinding machine SFP 120A available from Seiko Gijutsu Kabushiki Kaisha and thereafter presence or absence of scar and depression of optical fiber were checked with the optical microscope and the three-dimensional surface roughness configuration analysis system, Surfcom 590A-3DF available from TOKYO SEIMITSU.

COMPARATIVE EXAMPLE 1

200 parts by weight of aluminum oxide fine powder [WA#10000 available from Showa Denko K. K.] having the average particle size 800 mμ was added into a resin solution containing 50 parts by weight of a linear saturated polyester resin [Vylon #530 available from TOYOBO CO., LTD.], 70 parts by weight of toluene, and 70 parts by weight of methyl ethyl ketone, the mixture was well dispersed by sand mill, and thereafter it was diluted with an equal-amount mixture solvent of toluene and methyl ethyl ketone, thereby obtaining the coating agent [p] for abrasive layer having the viscosity of 100 cps.

The above coating agent [p] for abrasive layer was applied in 40 g (dry)/$m^2$ by the three-roll reverse process onto one surface (corona-treated surface) of the base for abrasive tape comprised of the polyethylene terephthalate film [corona-treated E 5100 type available from TOYOBO CO., LTD.] having the thickness of 75μ and thereafter the resultant was heated and dried, thereby obtaining the abrasive tape (P) as a product of a comparative example.

COMPARATIVE EXAMPLE 2

400 parts by weight of the colloidal silica sol [Organosilica sol MEK-ST, methyl ethyl ketone solvent, solid content 30% available from Nissan Chemical Industries] containing colloidal silica having the average particle size in the range of 10 to 20 mμ was added into a resin solution containing 30 parts by weight of the linear saturated polyester resin [Vylon #530 available from TOYOBO CO., LTD.], 40 parts by weight of toluene, and 40 parts by weight of methyl ethyl ketone and thereafter it was diluted with the equal-amount mixture solvent of toluene and methyl ethyl ketone, thereby obtaining the coating agent [q] for abrasive layer having the viscosity of 20 cps.

The above coating agent [q] for abrasive layer was applied in 5 g (dry)/$m^2$ by the gravure reverse process (screen ruling plate of 95 rulings and plate depth of 80μ) onto one surface (corona-treated surface) of the base for abrasive tape comprised of the polyethylene terephthalate film [corona-treated E 5100 type available from TOYOBO CO., LTD.] having the thickness of 75μ and thereafter the resultant was heated and dried, thereby obtaining the abrasive tape (Q) as a product of a comparative example.

Finishing of the end face of optical connector ferrule was carried out using the abrasive tapes (P) and (Q) obtained in Comparative Examples 1, 2, and the results showed that there were grinding scars and grinding spots on the surface of the end face of ferrule and the grinding characteristics thereof were not good.

Neither of the abrasive layers of the abrasive tapes (F), (G), (H), (F'), (G'), (H'), (I), (J), (K), (L), (M), (N), and (0) obtained by the above processes contains the coarse particles of 5 to 10μ due to cohesion of abrasive particles, and the arithmetical mean deviation (Ra) of the surface of each abrasive layer was 0.3 or less μ.

All the abrasive tapes of the above examples had good grinding characteristics of the end face of optical connector ferrule as compared with the abrasive tapes (P) and (Q) of the comparative examples, though they had transparency or, cloudy white or semitransparency depending upon the particle diameters of abrasive particles used or the formulation rate of the abrasive particles and binder. Namely, when they were used for finishing of the end face of optical connector ferrule, mirror finishing was achieved without any grinding scar or grinding spot, thus obtaining the optical connector ferrule excellent in the damping characteristics of optical signal.

The same finishing grinding tests were carried out for precision components including semiconductor wafers, metals, ceramics, color filters (for liquid crystal display or the like), plasma displays, optical lenses, magnetic disk or optical disk substrates, magnetic heads, and optical reading heads, instead of the optical connector ferrule. As a result, the same results were achieved as in the case of the optical connector ferrule.

According to the present invention, because the abrasive particles in the abrasive layer are fine particles having small and close particle diameters and there are no coarse particles of 5 to 10μ in the abrasive layer, finishing can be performed without grinding scar or grinding spot on the surface or the like of the precision component such as the optical connector ferrule or the semiconductor wafer.

Furthermore, the abrasive tape suitable for finishing and high in grinding performance can be obtained easily and certainly.

Furthermore, because the average particle size of the abrasive particles in the abrasive layer is maintained in the range of 1 to 200 mμ, the precision component such as the optical connector ferrule or the semiconductor wafer can be ground without any scar on the surface.

Furthermore, the coating agent can be obtained containing the abrasive having the average particle size in the range of 1 to 200 mμ.

Furthermore, the abrasive tape suitable for finishing can be obtained easily and certainly.

What is claimed is:

1. A process for producing an abrasive tape, comprising the steps of:

dispersing colloidal silica particles of an average particle size in the range of 10 to 100 mμ in a binder resin solution, producing aggregates of the colloidal silica particles in the binder resin solution to obtain a coating agent containing the colloidal silica particles of particle diameters 50 to 800 mμ, and applying the coating agent onto a base for abrasive tape.

2. The process for producing an abrasive tape according to claim 1, wherein said binder resin solution comprises a silicone based resin.

3. A process for producing an abrasive tape comprising the steps of:

preparing a base for abrasive tape;

mixing a colloidal silica particle solution containing colloidal silica particles of an average particle size in the range of 1 to 200 mμ and a solvent for colloidal silica particles, with a binder resin solution containing a binder and a binder solvent to produce a coating agent;

applying the coating agent onto the base for abrasive tape; and drying the coating agent thus applied.

4. The process for producing the abrasive tape according to claim 3, wherein said binder is a binder having siloxane bonding.

5. The process for producing the abrasive tape according to claim 3, wherein said step of applying the coating agent is carried out by a gravure reverse process.

6. The process for producing the abrasive tape according to claim 3, wherein said step of drying the coating agent has a step of heating the coating agent immediately after the coating agent is coated, thereby scattering the solvent for colloidal silica particles and the binder solvent in the coating agent.

7. The process for producing the abrasive tape according to claim 3, further comprising:

forming a primer layer over a surface on the base for abrasive tape before applying the coating agent onto the base for abrasive tape.

8. The process for producing an abrasive tape according to claim 1, wherein the colloidal silica particles are of a colloidal silica sol.

9. The process for producing an abrasive tape according to claim 3, wherein the colloidal silica particles are of a colloidal silica sol.

* * * * *